US007908027B2

(12) United States Patent
Noguchi et al.

(10) Patent No.: US 7,908,027 B2
(45) Date of Patent: Mar. 15, 2011

(54) SEWING MACHINE

(75) Inventors: Chikahisa Noguchi, Nagoya (JP); Toshihiro Hanai, Nagoya (JP); Eiichi Hamajima, Kasugai (JP); Yoshio Nishimura, Nagoya (JP); Eiichi Ito, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 915 days.

(21) Appl. No.: 11/723,926

(22) Filed: Mar. 22, 2007

(65) Prior Publication Data

US 2007/0227423 A1 Oct. 4, 2007

(30) Foreign Application Priority Data

Mar. 28, 2006 (JP) ..... 2006-088153

(51) Int. Cl.
*G06F 7/66* (2006.01)

(52) U.S. Cl. ..... 700/136; 112/271; 112/277

(58) Field of Classification Search ..... 700/136, 700/137, 138; 112/271, 272, 274, 275, 277, 112/475.02
See application file for complete search history.

(56) References Cited

U.S. PATENT DOCUMENTS

| | | | | |
|---|---|---|---|---|
| 4,784,071 | A * | 11/1988 | Sadeh et al. | 112/470.07 |
| 4,860,675 | A * | 8/1989 | Brower et al. | 112/470.06 |
| 5,271,345 | A * | 12/1993 | Matschulat et al. | 112/470.07 |
| 5,333,208 | A * | 7/1994 | Massen | 382/111 |
| 6,138,594 | A * | 10/2000 | Kito | 112/277 |
| 6,263,815 | B1 * | 7/2001 | Furudate | 112/475.02 |
| 2006/0015209 | A1 * | 1/2006 | Schweizer | 700/136 |
| 2006/0213415 | A1 * | 9/2006 | Konig et al. | 112/475.01 |

FOREIGN PATENT DOCUMENTS

| | | |
|---|---|---|
| JP | A 58-121987 | 7/1983 |
| JP | A 58-121988 | 7/1983 |
| JP | A 8-71288 | 3/1996 |
| JP | Y2 2593341 | 2/1999 |
| JP | A 11-267388 | 10/1999 |
| JP | A 2002-306878 | 10/2002 |
| JP | B2 3550185 | 4/2004 |

* cited by examiner

*Primary Examiner* — Gary L. Welch
*Assistant Examiner* — Nathan E Durham
(74) *Attorney, Agent, or Firm* — Oliff & Berridge PLC

(57) ABSTRACT

A sewing machine including a needle bar that has a sewing needle attached in a lower end thereof; a needle-bar vertical drive mechanism that vertically moves the needle bar by a sewing machine motor via a sewing machine motor main shaft; an imaging unit that captures image of at least the sewing needle and a moving object that is in close proximity of the sewing needle; a distance calculating portion that calculates a distance between the sewing needle and the moving object based on image data captured by the imaging unit; a judging portion that makes a judgment that the distance calculated by the distance calculating portion is equal to or less than a predetermined distance; and a control portion that controls execution of a predetermined safety operation based on a judgment result of the judging portion.

10 Claims, 14 Drawing Sheets

SEWING MACHINE

This application is based upon and claims the benefit of priority from the prior Japanese Patent Application 2006-088153, filed on, Mar. 28, 2006 the entire contents of which are incorporated herein by reference.

FIELD

The present disclosure is directed to a sewing machine that secures user safety when foreign objects such as user's fingers approach the sewing needle.

BACKGROUND

Sewing machines provided with safety covers have been suggested to keep external objects such as user's fingers away from a vertically moving sewing needle during a sewing operation. Also sewing machines have been suggested where a safety operation of some sort is executed upon optical detection of external objects such as user's fingers approaching the sewing needle.

A safety cover described in JP H11-267388 B (patent document 1) includes an arm coupled rotatably to a lower end of a presser bar, a protective plate formed integrally to a front end of the arm, and a lens provided in an open window of the protective plate. The protective plate of the safety cover is switchable between an active position that covers the front side of the needle bar and a retracted position retracted rearward.

A cloth presser unit of a sewing machine described in JP 2002-306878 A (patent document 2) is provided with two pairs of optical sensors composed of two light-receiving portions and two light-emitting portions. The two upwardly-oriented light-receiving portions are disposed on the upper surface of a presser holder that covers the upper side of a cloth presser foot so as to embrace the vertical movement locus (vertical reciprocating area of the sewing needle) of the sewing needle. The two downwardly-oriented light-emitting portions are disposed so as to confront the two light-receiving portions from above. When light projected from the respective light-emitting portions to the light-receiving portions are blocked by a foreign object, a control unit activates the needle swing/needle release pulse motor to drive the needle-bar release mechanism and block the transmission of drive force to the needle bar.

In order to employ the safety cover described in patent document 1 to a sewing machine, the presser foot needs to be removed from the presser bar. Thus, incorporation of the safety cover is cumbersome and time consuming for the user. Also, even if the safety cover is rotated to the retracted position, the safety cover still becomes an impediment upon needle threading, needle replacement, and presser foot replacement, providing poor workability.

According to the cloth presser unit of a sewing machine described in patent document 2, when light projected from the light-emitting portions to the light-receiving portions is blocked by foreign objects (such as user's fingers) in the vertical movement locus, a detection of foreign object is made. The problem with such configuration is that the detection range that allows detection of foreign object is extremely small. In order to increase the detection range, multiple pairs of light sensors are required, which brings adverse effects to cost reduction and compact spacing.

SUMMARY

An object of the present disclosure is to provide a sewing machine capable of securing user safety when foreign objects such as user's fingers approach the sewing needle by employing a configuration which is easy to install, provides good workability, is cost saving, and allows compact spacing.

The sewing machine of the present disclosure includes a needle bar that has a sewing needle attached in a lower end thereof; a needle-bar vertical drive mechanism that vertically moves the needle bar by a sewing machine motor via a sewing machine main shaft; an imaging unit that captures image of at least the sewing needle and a moving object that is in close proximity of the sewing needle; a distance calculating portion that calculates a distance between the sewing needle and the moving object based on image data captured by the imaging unit; a judging portion that makes a judgment that the distance calculated by the distance calculating portion is equal to or less than a predetermined distance; and a control portion that controls execution of a predetermined safety operation based on a judgment result of the judging portion.

According to such configuration, when a moving object such as a finger approaches the sewing needle during a sewing operation, an image of the sewing needle and the moving object that has approached the sewing needle are captured, and the distance (proximity distance) between the sewing needle and the moving object is calculated based on the image data captured. In case the calculated proximity distance is equal to or less than a predetermined distance, a predetermined safety operation is executed. Thus, user safety is reliably secured in case user's fingers approach the sewing needle.

In such case, mere provision of a single imaging unit allows wide-range detection of the moving object approaching the sewing needle. Hence, considerable enhancement of user safety can be achieved. Furthermore, the configuration of the present disclosure is easy to install, provides good workability, is cost saving, and allows compact spacing.

Also, the sewing machine of the present disclosure includes a needle bar that has a sewing needle attached in a lower end thereof; a needle-bar vertical drive mechanism that vertically moves the needle bar by a sewing machine motor via a sewing machine main shaft; an imaging unit that captures image of at least the sewing needle and a moving object that is in close proximity of the sewing needle; a time calculating portion that calculates a time taken for the moving object to enter a vertical movement locus of the sewing needle based on image data captured by the imaging unit; a judging portion that makes a judgment that the time calculated by the time calculating portion is equal to or less than a predetermined time; and a control portion that controls execution of a predetermined safety operation based on a judgment result of the judging portion.

According to such configuration, the time taken (arrival time) for the moving object to enter the vertical movement locus of the sewing needle is calculated based on the image data containing the image of the sewing needle and the moving object approaching the proximity of the sewing needle. In case the calculated arrival time is equal to or less than the predetermined time, the predetermined safety operation is executed. Thus, user safety can be reliably secured in case foreign objects such as user's fingers approach the sewing needle.

In such case also, mere provision of a single imaging unit considerably enhances user safety. Also, the configuration of the present disclosure is easy to install, provides good workability and moreover is cost saving and allows compact spacing.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

Figure 1:
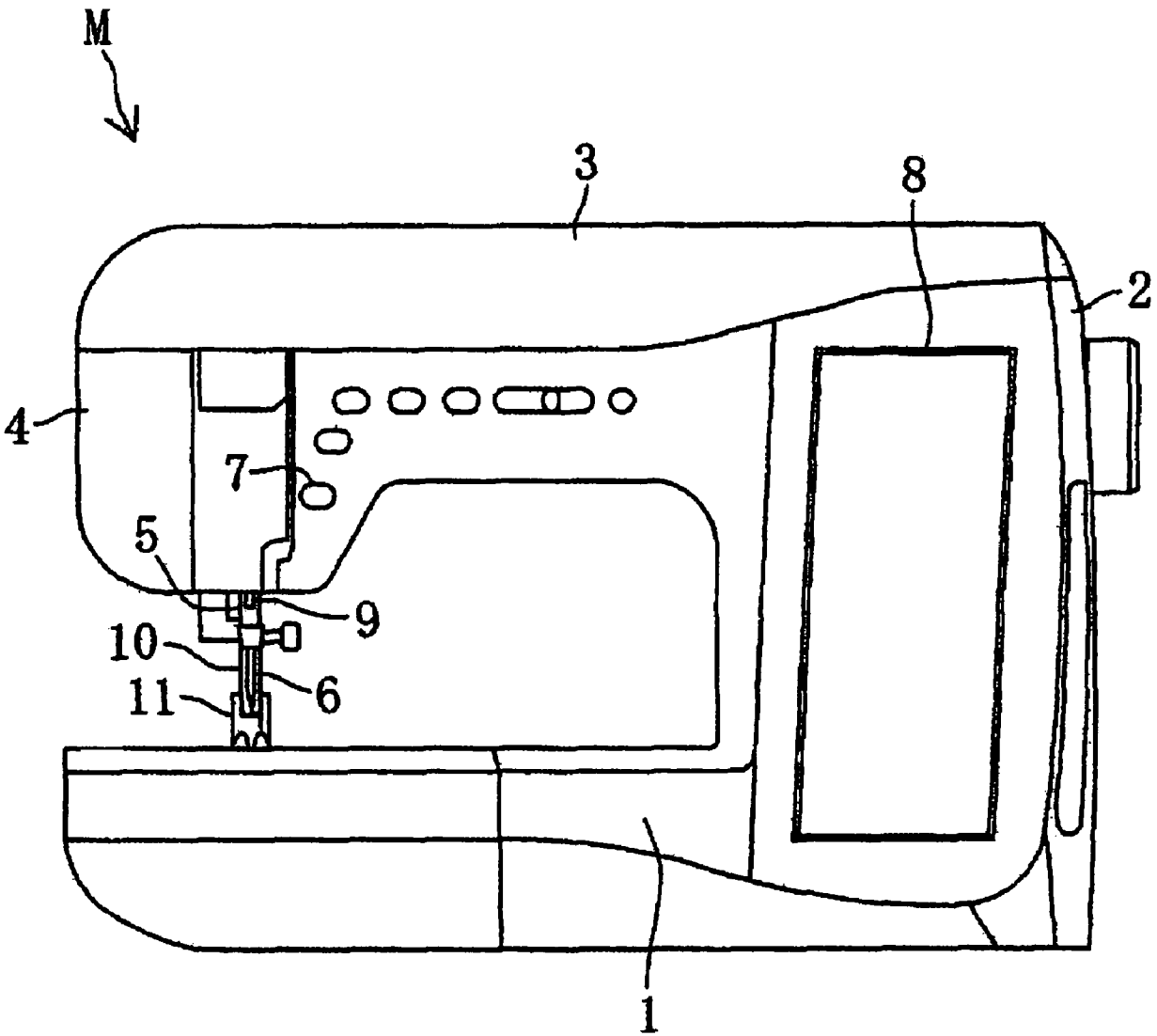
FIG. 1 is a front view of a lockstitch sewing machine in its entirety in accordance with a first illustrative aspect of the present disclosure.
Figure 2:
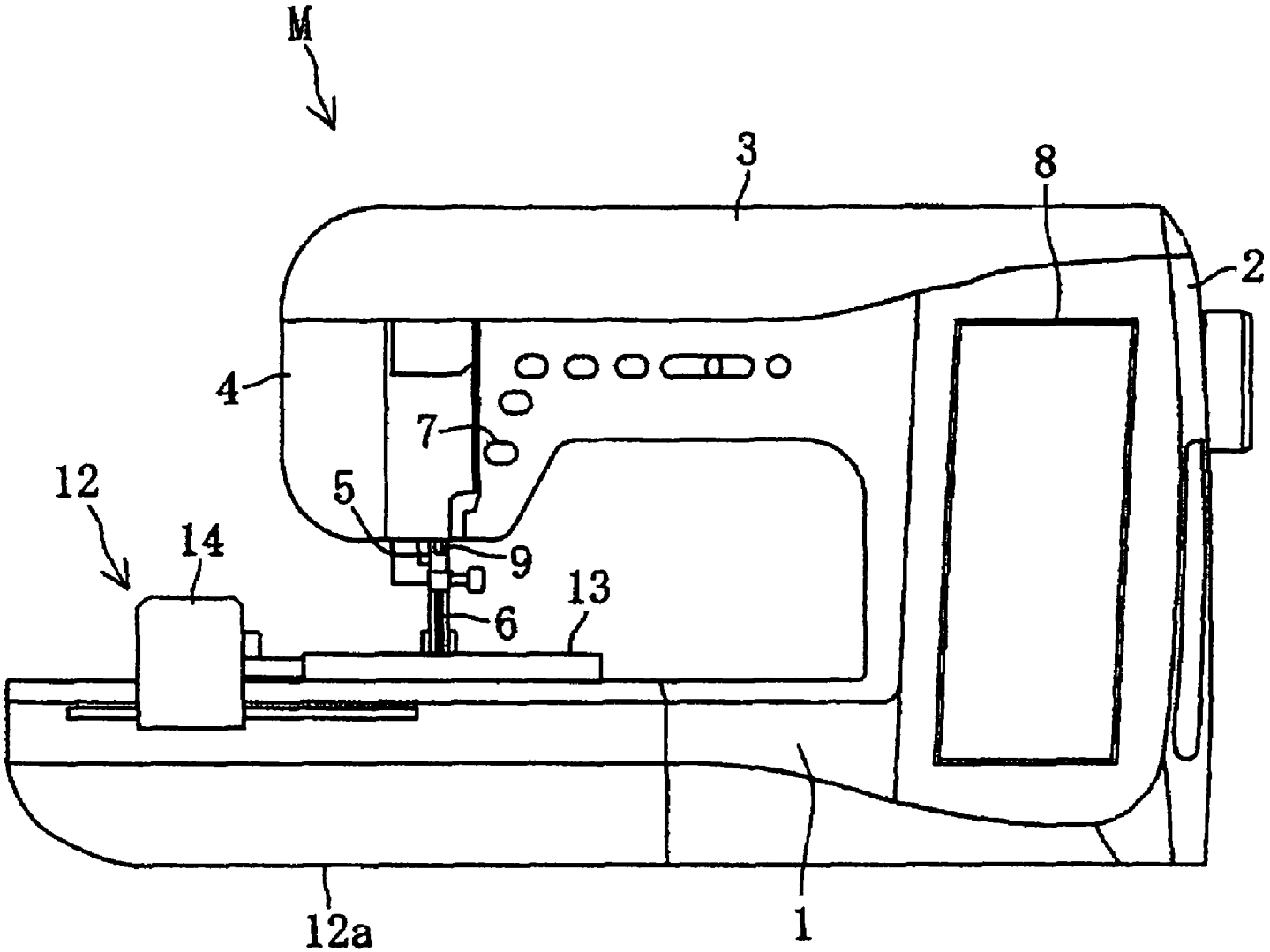
FIG. 2 is a front view of a lockstitch sewing machine in its entirety with an embroidery unit attached.

A first embodiment of the present disclosure is described with reference to FIGS. 1 to 11. FIG. 1 illustrates a lockstitch sewing machine M with an embroidery unit detached, and FIG. 2 illustrates the lockstitch sewing machine M with the embroidery unit attached to enable embroidery sewing.

Referring to FIG. 1, the lockstitch sewing machine M includes a bed 1, a pillar 2 standing on the right end of the bed 1, and an arm 3 extending leftward from the upper end of the pillar 2 so as to confront the bed 1. The bed 1 is provided with a free arm (not shown) allowing attachable/detachable attachment of an embroidery unit 12 (refer to FIG. 2) thereto and the attachment of the embroidery unit 12 allows execution of embroidery sewing by the lockstitch sewing machine M.

The bed 1 includes a cloth feed mechanism, a loop taker, and a thread cutting mechanism (none of which are shown). The cloth feed mechanism is provided with a feed dog vertically moving mechanism that vertically moves the feed dog and the feed dog longitudinally moving mechanism that longitudinally moves the feed dog (neither of which are shown). The loop taker is composed of a horizontal rotary shuttle containing a bobbin (not shown) therein and operates in cooperation with the sewing needle 6. The thread cutting mechanism cuts a needle thread and a bobbin thread.

A start/stop switch 7 that instructs start and stop of a sewing operation is provided in the front face of the arm 3. Provided in the front face of the pillar 2 is a liquid crystal display 8 capable of displaying color images. The liquid crystal display 8 displays various normal stitch patterns (normal patterns), various function names, pattern names, and various messages, and the like. Touch keys (not shown) composed of transparent electrodes are provided in the front face of the liquid crystal display 8 and pattern selection of the patterns to be sewn and selection of functions to be executed are rendered by operating the applicable touch keys.

Provided in the underside of the head 4, more specifically in the portion forward relative to a needle bar 5 is a downwardly oriented image sensor 9 capable of capturing color images. The image sensor 9 is configured by a CCD (charge coupled device) imaging element and captures images of a workpiece cloth W (refer to FIGS. 9 to 11) placed on the upper surface of the bed 1 from a substantially upward direction.

Figure 10:
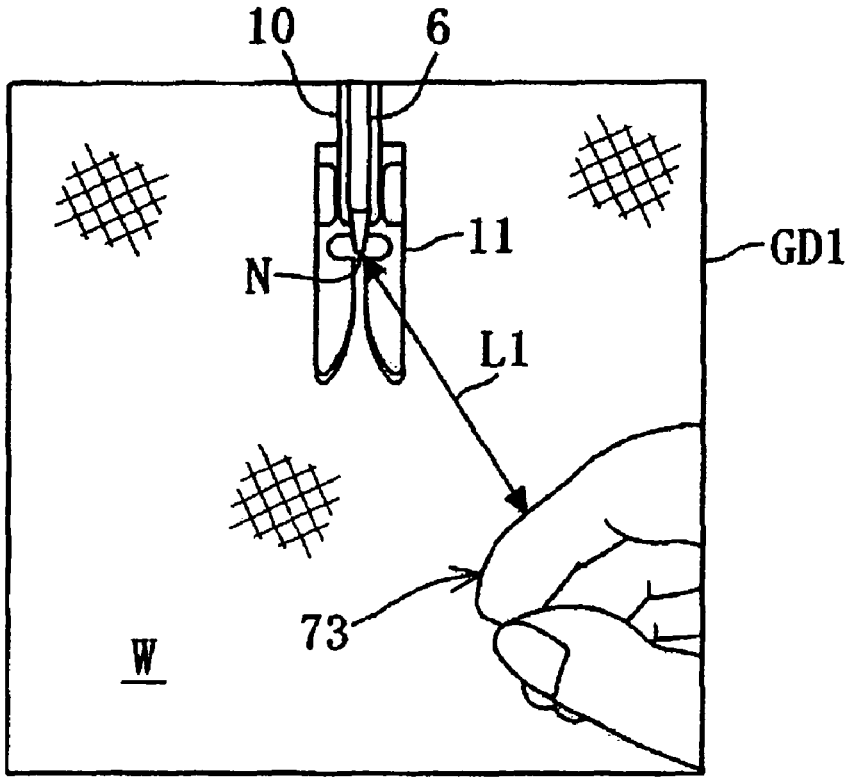
FIG. 10 illustrates an image data captured after sewing start.

When the workpiece cloth W to be sewn is placed on the upper surface of the bed 1, the image sensor 9 obtains an image of a substantially rectangular imaging range illustrated in FIG. 10. The imaging range captures the sewing needle 6 attached to the lower end of the needle bar 5, a presser foot 11 attached to the lower end of the presser bar 10 and the moving object 73 in close proximity of the sewing needle 6 in addition to the workpiece cloth W.

Figure 3:
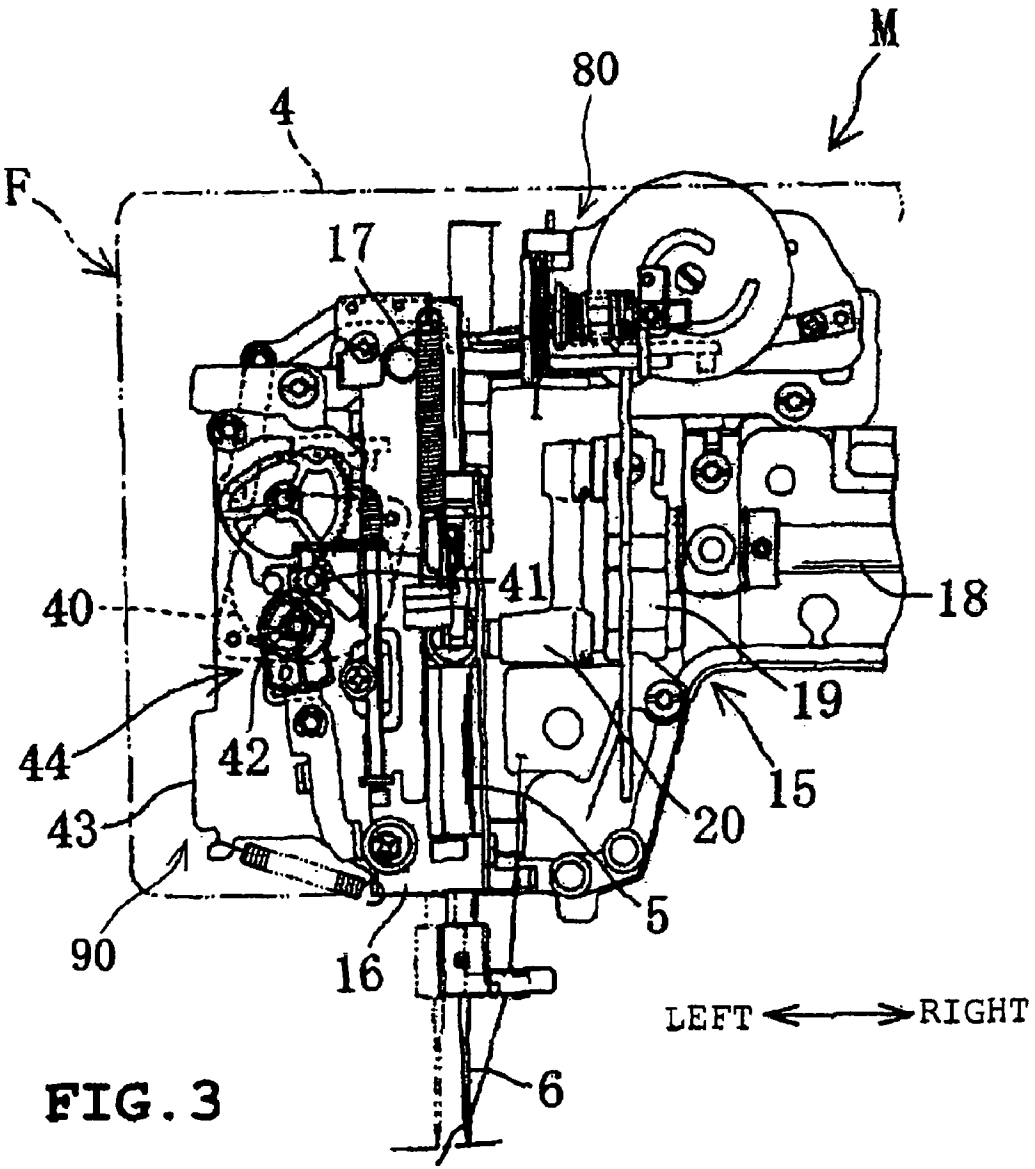
FIG. 3 is a partial front view illustrating an inner configuration of a head of the lockstitch sewing machine.
Figure 4:
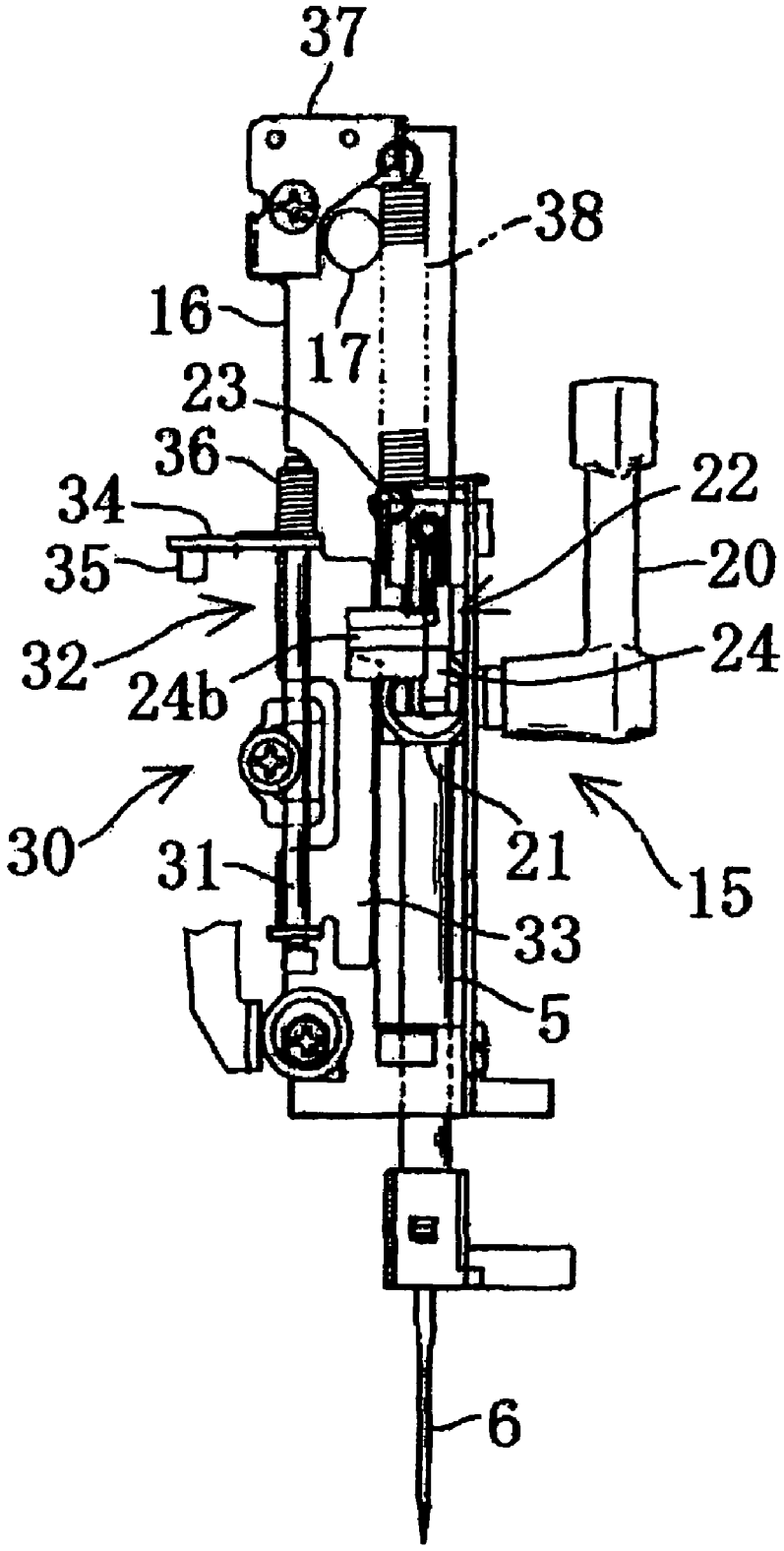
FIG. 4 is a partial front view illustrating a needle-bar vertical drive mechanism and a needle-bar release mechanism.

Referring to FIG. 3, provided in the head 4 of the lockstitch sewing machine M is a needle-bar vertical drive mechanism 15, a thread tension mechanism 80, a needle-bar swing mechanism 90 and a needle-bar release mechanism 30 (refer to FIG. 4). The needle-bar vertical drive mechanism 15 vertically drives the needle bar 5. The thread tension mechanism 80 applies tension on the needle thread residing in a needle thread route extending from a thread spool (not shown) to the sewing needle 6. The needle-bar swing mechanism 90 swings the needle bar 5 in a direction perpendicular (lateral direction) to a cloth feed direction. The needle-bar release mechanism 30 blocks the transmission of drive force that vertically moves the needle bar 5. The needle-bar swing mechanism 90 and the needle-bar release mechanism 30 are driven by a drive force of a single common drive motor 40.

Next, a description will be given on the needle-bar vertical drive mechanism 15 based on FIGS. 3 to 5.

A vertically oriented needle-bar support 16 is disposed in the substantially central portion of the head 4. The upper end of the needle-bar support 16 is pivoted to a frame F by a pivot pin 17, whereby the needle-bar support 16 is rendered swingable relative to the frame F. The needle bar 5 is supported vertically movably by the needle-bar support 16 and the sewing needle 6 is attachably/detachably attached to the lower end of the needle bar 5.

Secured at the distal end of a sewing machine main shaft 18 rotated by a sewing machine motor 56 (refer to FIG. 7) is a thread take-up crank 19. At one end of the thread take-up crank 19, a needle-bar crank rod 20 is coupled rotatably at one end thereof (the upper end in FIGS. 3 and 4) and a needle-bar clamp 21 is coupled at the other end thereof. The above described needle bar 5 is vertically moved via the needle-bar clamp 21 and a later described coupling mechanism 22.

Next, a description will be given on the coupling mechanism 22. The needle bar 5 has the needle-bar clamp 21 supported slidably thereto and a securing element 23 secured thereto. The securing element 23 has an upper end of a vertically-oriented swinging element 24 rotatably pivoted thereto. The swinging element 24 is elastically biased by a torsion spring 25 so that an engagement projection 24*a* provided in the lower end of the swinging element 24 is engaged with an engagement recess 21*a* of the needle-bar clamp 21.

When the sewing machine main shaft 18 is rotated by the sewing machine motor 56, the needle-bar clamp 21 is vertically moved via the thread take-up crank 19 and the needle-bar crank rod 20. At this time, the needle bar 5 is vertically reciprocated via the coupling mechanism 22.

Next, a description will be given on the needle-bar release mechanism 30 that blocks synchronization of the needle bar 5 and the sewing machine main shaft 18.

Figure 5:
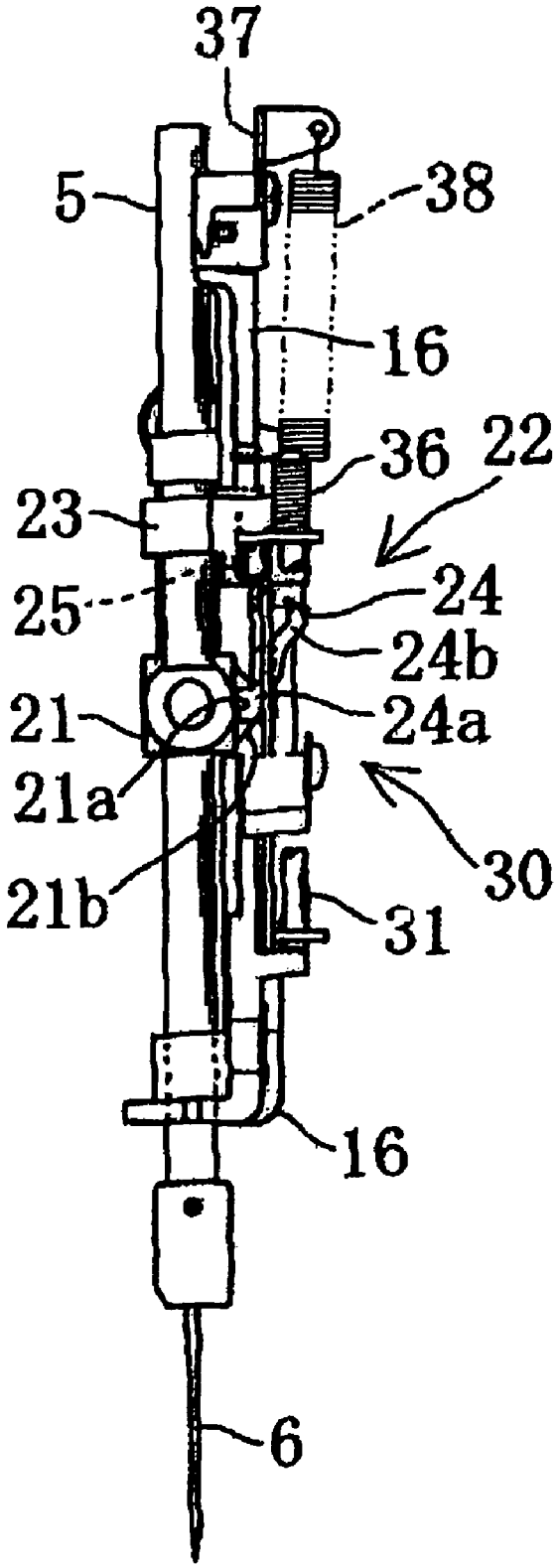
FIG. 5 is a partial side view illustrating a needle-bar vertical drive mechanism and a needle-bar release mechanism.

Referring to FIGS. 4 and 5, a vertically oriented rotary shaft 31 is secured in the substantial lower-half portion of the left side of the needle-bar support 16. The rotary shaft 31 has rotatably pivoted thereto a blocking plate 32 being integrally formed by an activating plate 33 in plate-form and a drive lever 34. The lateral width of the activating plate 33 corresponds to the substantial left-half width of the needle-bar support 16 and the vertical length of the of the activating plate 33 corresponds to the length of the substantial lower half of the needle-bar support 16.

An engagement pin 35 is secured at the distal end of the drive lever 34 and the engagement pin 35 is capable of abutting a blocking cam 44*b* (refer to FIG. 6) of a later described first cam 44 from the rearward direction. Also, the blocking plate 32 is biased counterclockwise in plan view by a coil spring 36 and the activating plate 33 is capable of engaging with an engagement projection 24*b* of the swinging element 24 from the rearward direction.

When the first cam 44 is rotated clockwise, the engagement pin 35 is moved rearward by the blocking cam 44*b*. At this time, the blocking plate 32 is rotated clockwise in plan view and the activating plate 33 is engaged with the engagement projection 24*b*. Thus, the engagement projection 24*a* of the swinging element 24 is separated from the engagement recess 21*a* of the needle-bar clamp 21, thereby blocking the transmission of the drive force that vertically moves the needle bar 5.

An extension coil spring 38 is hooked on a spring receptacle 37 mounted on the needle-bar support 16. When the engagement projection 24*a* of the swinging element 24 is separated from the engagement recess 21*a* of the needle-bar clamp 21, the needle bar 5 swings to the uppermost position by the extension coil spring 38 and is maintained at the uppermost position. After the transmission of drive force to vertically move the needle bar 5 has been blocked, the blocking plate 32 returns to a stand-by position as illustrated in FIG. 4. When the needle-bar clamp 21 is lifted from this state, the engagement projection 24*a* automatically engages with the engagement recess 21*a* with guidance of a sloped guide surface 21*b* of the needle-bar clamp 21. Thus, the coupling of the needle bar 5 and the sewing machine main shaft 18 is reestablished to allow vertical movement of the needle bar 5.

Figure 6:
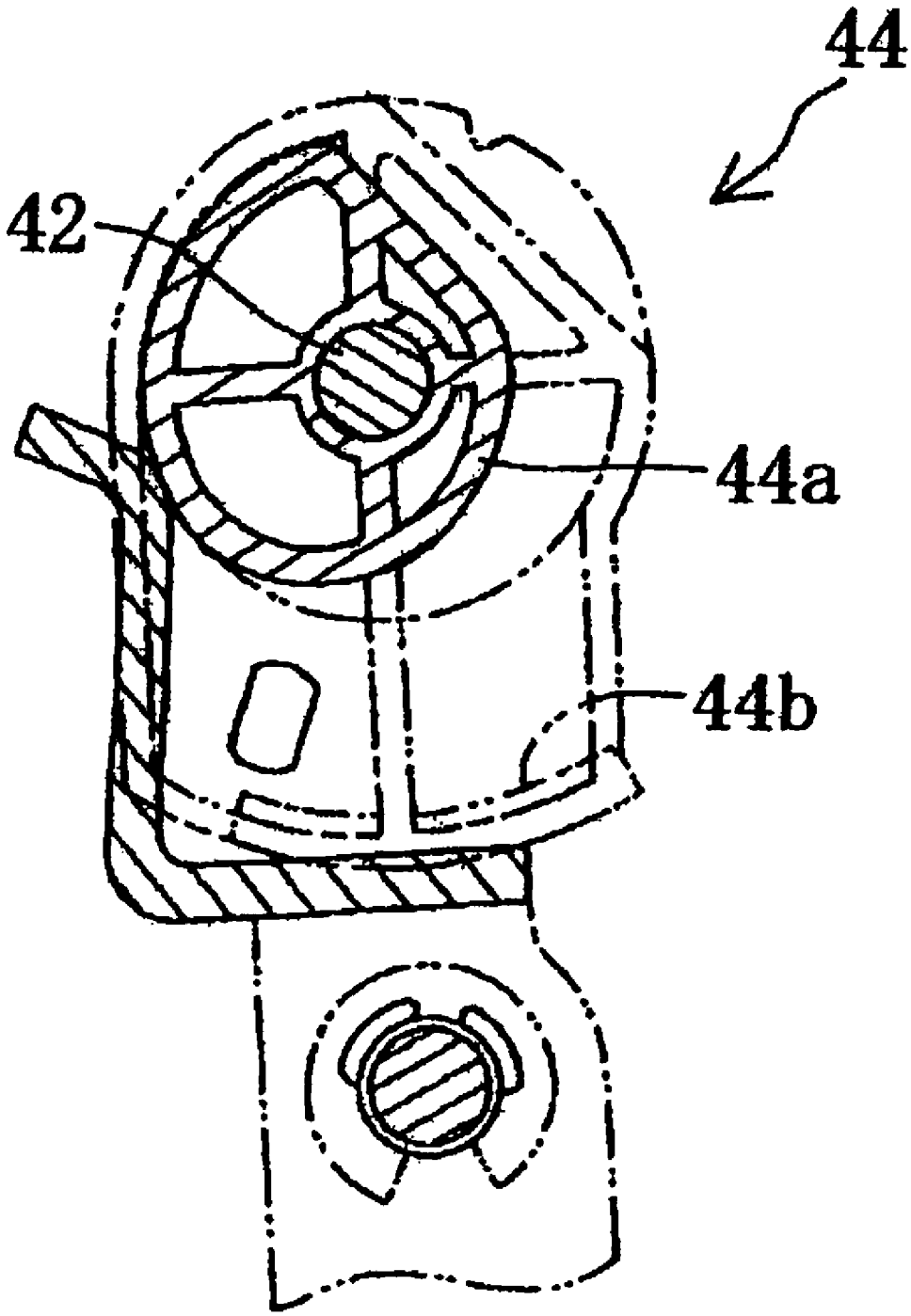
FIG. 6 is a vertical sectional front-view of a first cam member.

Referring to FIG. 3, a drive motor 40 composed of a step motor is disposed in the mid portion of the head 4 and a drive gear 41 is secured to a drive shaft of the drive motor 40. Secured on an auxiliary frame 43 below the drive shaft of the drive motor 40 is a rear end of a longitudinally-oriented first pivot shaft 42. Referring to FIG. 6, the first pivot shaft 42 has the first cam 44 pivoted rotatably thereto. The first cam 44 has formed thereto a swing cam 44*a* eccentric with respect to the first pivot shaft 42 and a blocking cam 44*b* projecting rearward.

Immediately after power is supplied to the lockstitch sewing machine M, the drive motor 40 is driven for initializing purposes and initial setting is performed. When a sewing process is executed in this state, the needle bar 5 is moved vertically as well as being swung by the drive of the drive motor 40 proportionate to the swing width. Then stitches are formed on the workpiece cloth W by using a needle thread subject to optimized thread tension.

The first cam 44 reaching a predetermined phase angle by the drive of the drive motor 40 denotes a start of a blocking period where synchronization between the needle bar 5 and the sewing machine main shaft 18 is blocked. In the blocking period, since the engagement pin 35 is moved rearward by the blocking cam 44*b*, the blocking plate 32 is rotated clockwise in plan view and the engagement projection 24*a* of the swinging element 24 is separated from the engagement recess 21*a* of the needle-bar clamp 21. Thus, the synchronization of the needle bar Sand the sewing machine main shaft 18 is blocked and the needle bar 5 is slid to the uppermost position by the extension coil spring 38 and retained at the uppermost position.

Referring to FIG. 2, the embroidery unit 12 includes a body frame 12*a*, an embroidery frame 13 that holds the workpiece cloth W, a Y-direction drive portion 14, and an X-direction drive mechanism (not shown). The Y-direction drive portion 14 houses therein a Y-direction drive mechanism (not shown) that drives the embroidery frame 13 in the Y-direction (longitudinal direction). The X-direction drive mechanism (not shown) is contained in the body frame 12*a* and drives the Y-direction drive portion 14 in the X-direction (lateral direction).

The Y-direction drive portion 14 is provided with a carriage (not shown) and the carriage has the embroidery frame 13 attached attachably/detachably thereto via a connection portion (not shown). The X-direction drive mechanism drives the Y-direction drive mechanism inclusive of the carriage in the X-direction by the drive of an X-shaft drive motor 60. The Y-direction drive mechanism drives the carriage in the Y-direction by the drive of a Y-shaft drive motor 61.

When the embroidery unit 12 is attached to the free arm, the X-shaft drive motor 60 and the Y-shaft drive motor 61 establish electrical connection with a control unit 50 of the lockstitch sewing machine M. The control unit 50 controls the drive of the X-shaft drive motor 60 and the Y-shaft drive motor 61 respectively. By connecting the embroidery frame 13 having the workpiece cloth W attached thereto to the carriage, the embroidery frame 13 can be moved in the X- and Y-directions, thereby allowing formation of embroidery patterns on the workpiece cloth W.

Next, a description will be given on a control system of the lockstitch sewing machine M.

Figure 7:
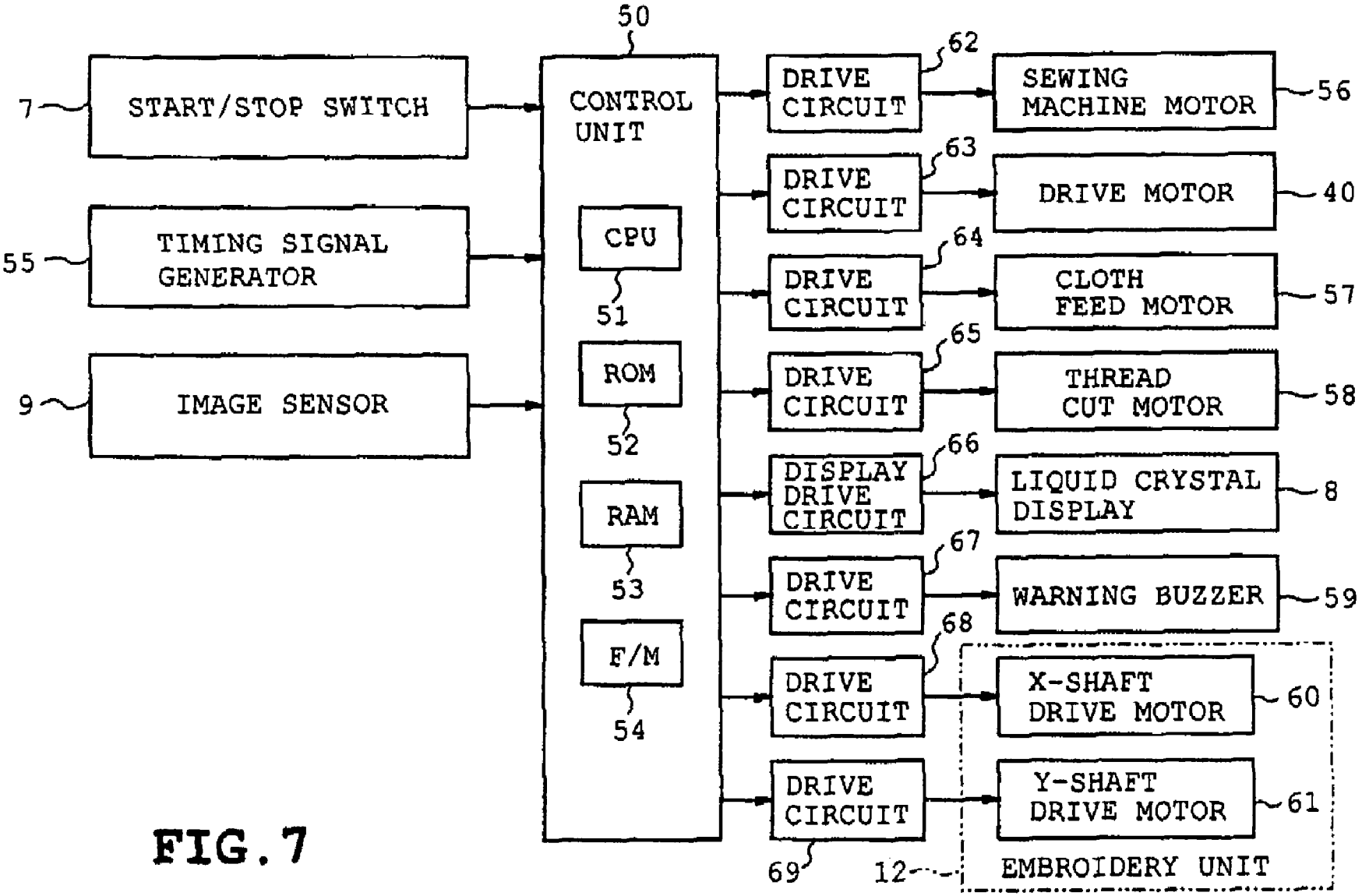
FIG. 7 is a block diagram of a control system of the lockstitch sewing machine.

Referring to FIG. 7, the control unit 50 is configured by a computer including a CPU 51, a ROM 52, a RAM 53 and an electrically-rewritable nonvolatile flash memory (F/M) 54.

The control unit 50 has connected thereto a start/stop switch 7, a timing signal generator 55 that detects the rotational position of the sewing machine main shaft 18, and the image sensor 9 respectively. Also, the control unit 50 has connected thereto a drive circuit 62 for the sewing machine motor 56; a drive circuit 63 for the drive motor 40; a drive circuit 64 for a cloth feed motor 57 that drives the cloth feed mechanism; a drive circuit 65 for a thread cut motor 58 that drives the thread cut mechanism; a display drive circuit 66 for the liquid crystal display 8; a drive circuit 67 for a warning buzzer 59; and two drive circuits 68 and 69 respectively. When the embroidery unit 12 is attached to the lockstitch sewing machine M, the X-shaft drive motor 60 is connected with the drive circuit 68 and the Y-shaft drive motor 61 is connected with the drive circuit 69.

The ROM 52 has preinstalled therein a sewing control program that sews various utility patterns and embroidery patterns; control programs for display control in general; and a later described control program for safety control. Areas for providing flags, pointers, counters, registers, and buffers and the like required for execution of various controls are allocated in the RAM 53 on a required basis.

Next, the safety control executed by the control unit 50 of the lockstitch sewing machine M will be described based on the flowcharts indicated in FIGS. 8A, 8B and 8C. The reference symbol Si (i=11, 12, 13 . . . ) in the drawings indicate each step number of the control.

The control unit 50 starts the control when power is supplied to the lockstitch sewing machine M. First, an imaging process is executed by the image sensor 9 (step S11). In the imaging process, the control unit 50 captures image of the front side portion of the sewing needle 6 within the rectangular imaging range (refer to FIGS. 9 to 11). The image is captured from the direction rearward relative to the sewing needle 6. Imaging of a portion of the workpiece cloth W, a presser foot 11, a portion of the sewing needle 6, and the moving object 73 are allowed in the imaging range. When the imaging process is terminated, the control unit 50 proceeds to step S12 to determine whether a start operation has been operated on the start/stop switch 7 or not. In case a start operation is not operated (NO), the control unit 50 repeats steps S11 and S12. In case a start operation has been operated on the start/stop switch 7 in step S12 (YES), the control unit 50 proceeds to step S13, and the image data containing the status immediately before sewing start is stored in the flash memory 54. The image data may be stored in the RAM 53 instead of the flash memory 54.

Next, the control unit 50 proceeds to step S14 to execute a sewing process by driving the sewing machine motor 56. When the sewing process is executed, the control unit 50 judges whether or not a stop operation is operated on the start/stop switch 7 (step S15). In case the stop operation is not operated on the start/stop switch 7 (No), the control unit 50 executes the imaging process (step S16) by the image sensor 9 while continuing the sewing process and executes a moving object detection process (step S17) based on the image data captured. In the moving object detection process, the control unit 50 compares the image data captured immediately before sewing start (refer to FIG. 9), in other words, the image data containing no images of moving objects 73, and the image data captured in step S16 after sewing start (refer to FIG. 10 or FIG. 11).

In the moving object detection process, first, the control unit 50 binarizes the image data is by using a "threshold value" that identifies the components of the sewing machine such as the presser foot 11, the presser bar 10, and the sewing needle 6 and the moving object 73 by the control unit 50. Then, the control unit 50 executes noise cancellation process, and the like on the image data and thereafter executes an outline extraction process that extracts the outlines of the presser foot 11, the presser bar 10, the sewing needle 6 and the moving object 73.

Among the objects contained in the image data immediately before sewing start, the sewing needle 6 is moved vertically with regularity, and the workpiece cloth W is moved with regularity in the sewing direction in correlation with the cloth feed movement. On the other hand, user's fingers and various objects such as scissors used by the user involve irregular motion. Thus, such objects hinder safety when they come into contact with the sewing needle 6. Such being the case, the control unit 50 excludes objects assuming regular motion from the moving object 73 and detects only the objects assuming irregular motion as the moving object 73. A needle drop position N of the sewing needle 6 taken on the workpiece cloth W is predetermined in the image data.

Subsequently, the control unit 50 proceeds to step S18 and judges whether or not a moving object 73 has been detected by the moving object detection process. If no moving object 73 has been detected (NO), the control unit 50 repeats steps S15 onwards. If a moving object 73 has been detected (YES), the control unit 50 proceeds to step S19 and calculates the horizontal distance between the sewing needle 6 and the moving object 73 as a proximity distance D. Then, the control unit 50 proceeds to step S21 and determines whether or not an embroidery mode is selected. In case of sewing a normal pattern without attachment of the embroidery unit 12 upon sewing start, the embroidery mode will not be selected. In case the embroidery mode is not selected in step S21 (NO), the control unit 50 proceeds to step S30 and judges the value of the proximity value Din a step-by-step manner. Then, the predetermined safety operation is executed based on the result of judgment of the proximity distance D.

If proximity distance D is greater than 50 mm (D>50 mm), in other words, if there is no possibility of the moving object 73 contacting (interfering) with the sewing needle 6, the control unit 50 repeats steps S15 onwards. If the proximity distance D is equal to or less than 50 mm and greater than 30 mm (50 mm≧D>30 mm), the control unit 50 proceeds to step S31 and warns the user by the warning buzzer 59. If the proximity distance D is equal to or less than 30 mm and greater than 10 mm (30 mm≧D≧10 mm), the control unit 50 proceeds to step S32 and executes a deceleration process that decelerates the rotational speed of the sewing machine motor 56 to a predetermined speed. Then, the control unit 50 warns the user by activating the warning buzzer 59 (step S33) and displays a warning message to the liquid crystal display 8 (step S34).

If the proximity distance D is equal to or less than 10 mm (D≦10 mm), in other words, if the moving object 73 is in immediate proximity of the sewing needle 6, the control unit 50 proceeds to step S35 and executes a release operation that blocks synchronization of the needle bar 5 and the sewing machine main shaft 18. In the release operation, the needle bar 5 is released via the needle-bar release mechanism 30 by driving the drive motor 40. Next, the control unit 50 proceeds to step S36 and brings the sewing machine motor 56 to an emergency halt. Then, the control unit 50 warns the user of the emergency halt by activating the warning buzzer 59 (step S37) and displays a warning message to the liquid crystal display 8 (step S38). Thereafter, the control unit 50 repeats steps S11 onwards.

On the other hand, when the embroidery unit 12 is attached upon sewing start to sew embroidery patterns, the embroidery mode is selected. If the embroidery mode is selected in step S21 (YES), the control unit 50 proceeds to step S22 and judges the value of the proximity distance D in a step-by-step manner. Then, a predetermined safety operation is executed based on the result of judgment of the proximity distance D. The judgment value applied for step-by-step judgment of the proximity distance D by the control unit 50 in the embroidery mode is set at a larger value as compared to non-embroidery mode values (such as 50 mm, 30 mm and 10 mm applied in the above step S30).

If the proximity value D is greater than 100 mm (D>100 mm), in other words if there is no possibility of the moving object 73 contacting the sewing needle 6, the control unit 50 repeats steps S15 onwards. If the proximity distance D is equal to or less than 100 mm and greater than 50 mm (100 mm≧D>50 mm), the control unit 50 proceeds to step S23 and executes the deceleration process that decelerates the rotational speed of the sewing machine motor 56 to a predetermined speed. Then, the control unit 50 warns the user by activating the warning buzzer 59 (step S24) and displays a warning message to the liquid crystal display 8 (step S25).

If the proximity distance D is equal to or less than 50 mm (D≦50 mm), in other words, if the moving object 73 is in immediate proximity of the sewing needle 6, the control unit 50 proceeds to step S26 and executes the release operation of the needle bar 5. In the release operation, the needle bar 5 is released via the needle-bar release mechanism 30 by driving the drive motor 40. Next, the control unit 50 proceeds to step S27 and brings the sewing machine motor 56 to an emergency halt. Then, the control unit 50 warns the user of the emergency halt by activating the warning buzzer 59 (step S28) and displays a warning message to the liquid crystal display 8 (step S29). Thereafter, the control unit 50 repeats steps S11 onwards.

When the stop operation is operated on the start/stop switch 7 the control unit 50 makes a YES judgment in step S15 and stops the drive of the sewing machine motor 56 (step S20).

Next, a description will be given on the safety operation carried out in accordance with the above configuration.

Figure 9:
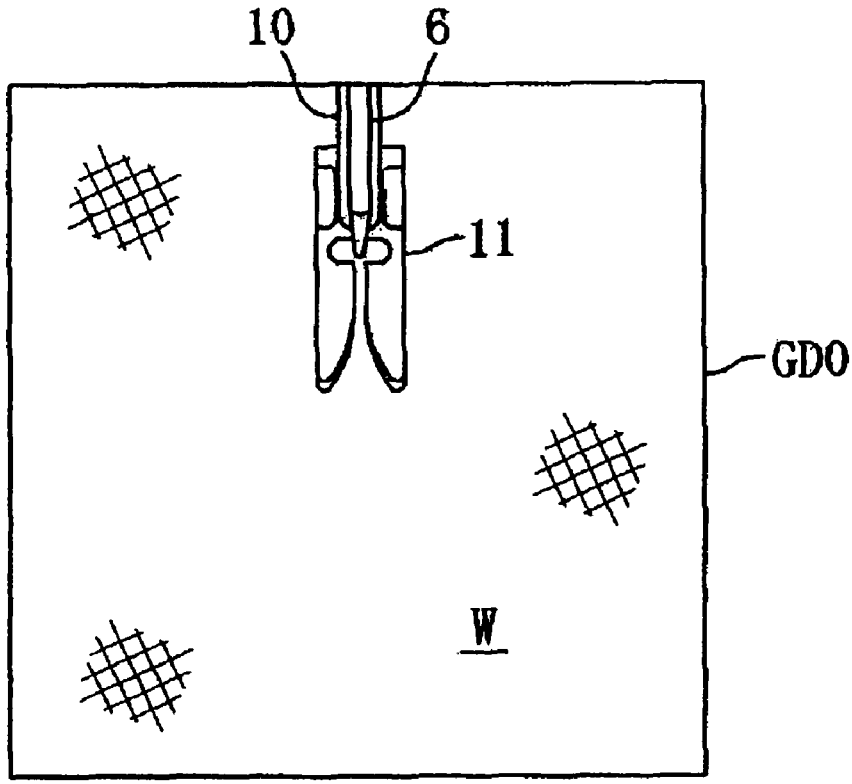
FIG. 9 illustrates an image data captured immediately before sewing start.

FIG. 9 illustrates image data GD0 captured immediately before the start operation of the start/stop switch 7. The image data GD0 does not contain any moving object 73 such as user's fingers whatsoever but only contains a portion of the workpiece cloth W, the presser foot 11, the sewing needle 6 and a portion of the presser bar 10. The image data GD0 is stored in the flash memory 54.

FIG. 10 illustrates image data GD1 captured after start operation of the start/stop switch 7 and the start of normal pattern sewing. The image data GD1 contains user's fingers as moving objects 73 in addition to a portion of the workpiece cloth W, the presser foot 11, the sewing needle 6 and a portion of the presser bar 10. In the image data GD1, the presser foot 11 is consistently placed in a substantially fixed position and the workpiece cloth W is moved horizontally in the sewing direction intermittently. Also, the presser bar 10 and the sewing needle 6 are vertically driven with regularity. Thus, the portion of workpiece cloth W, the presser foot 11, the sewing needle 6 and the portion of the presser bar 10 are excluded from the moving object 73 detected by the moving object detection process.

On the other hand, objects such as user's fingers and hands have no regularity in their motion. Thus, such objects with no regular motion are detected as a moving object 73 by the moving object detection process. The state illustrated by FIG. 10 has a proximity distance L1 greater than 50 mm, thus, there is no possibility of the moving object 73 contacting the sewing needle 6, therefore no warning operation (activation of the warning buzzer 59, display of warning message, and the like) is executed whatsoever.

Figure 11:
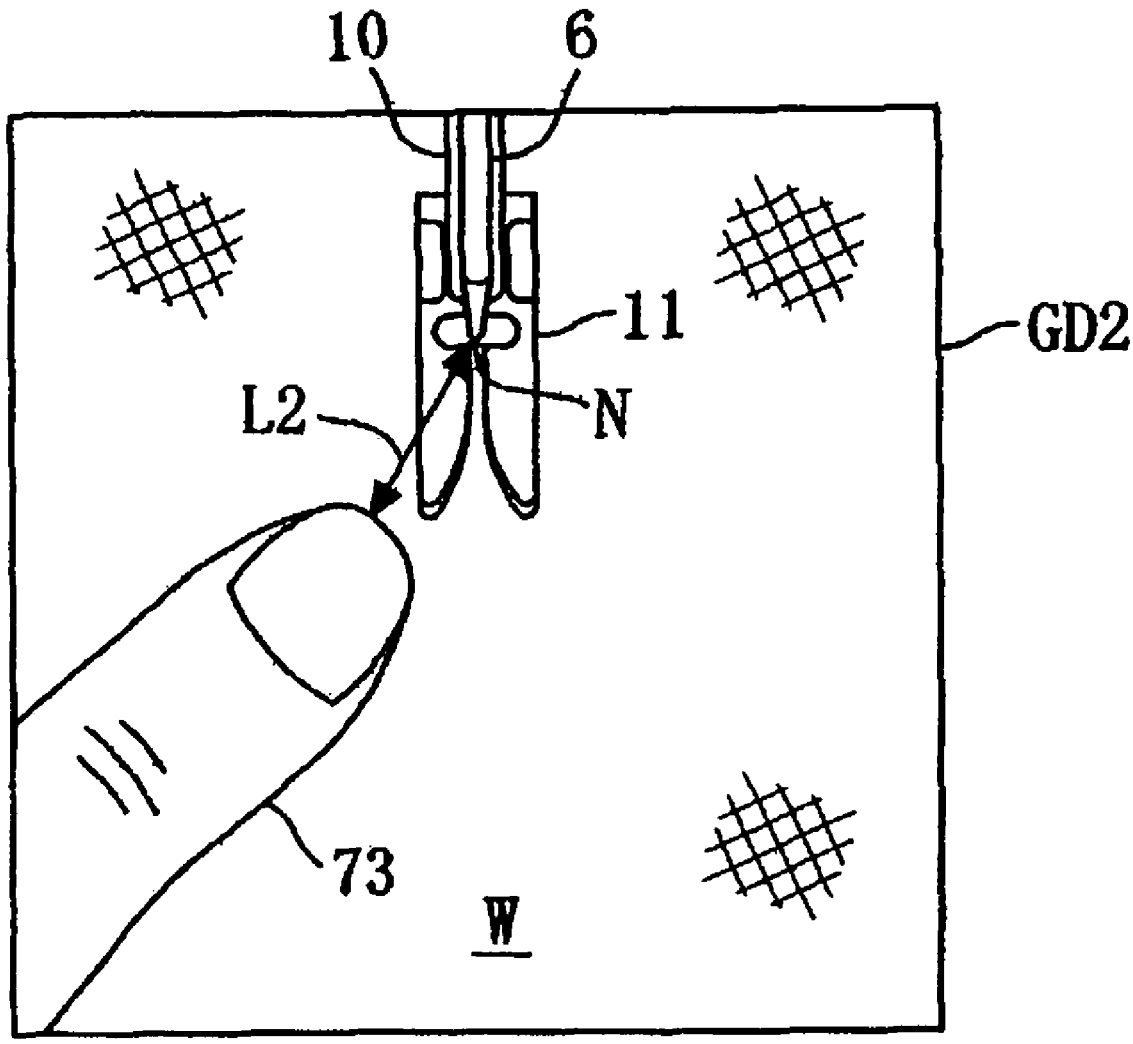
FIG. 11 illustrates an image data captured after sewing start.

FIG. 11 illustrates image data GD2 captured during the sewing operation. The image GD2 contains user's fingers in addition to the objects excluded from moving objects 73 in the moving object detection process. In the state illustrated in FIG. 11, since the proximity distance L2 is approximately 15 mm, it is highly probable that the moving object 73 will contact the sewing needle 6. Thus, the rotational speed of the sewing machine motor 56 is decelerated, the warning buzzer 59 is activated and the warning message is displayed to the liquid crystal display 8. This leads to improvement in safety since the user is allowed to avoid danger by retracting his/her fingers.

Though not shown, when user's fingers approach the immediate proximity of the needle drop position N of the sewing needle 6 (within several mm for example), the sewing machine motor 56 is brought to an emergency halt and the warning buzzer 59 is activated to announce the emergency halt of the sewing machine and the warning message is displayed to the liquid crystal display 8. Thus, user safety is improved since the user is allowed to avoid danger by immediate retraction of his/her fingers.

As described above, according to the present embodiment, when moving objects 73 such as user's fingers approach the sewing needle 6 during the sewing operation, an image of the sewing needle 6 and the moving object 73 in close proximity of the sewing needle 6 are captured, based upon which the distance between the sewing needle 6 and the moving object 73 is calculated as the proximity distance D. Then, if the calculated proximity distance D is equal to or less than the predetermined distance, the predetermined safety operation is executed. Thus, when user's fingers or the like approach the sewing needle 6, user safety can be secured reliably.

In such case, mere provision of a single imaging sensor 9 allows wide-range detection of a moving object 73 approaching the sewing needle. Hence, considerable enhancement of user safety can be achieved. Furthermore, the configuration of the present disclosure is easy to install, provides good workability, is cost saving and allows compact spacing. Thus, user safety can be secured reliably when user's fingers or the like approach the sewing needle 6.

In case the calculated proximity distance D is equal to or less than the predetermined distance, the predetermined safety operation is executed based on the result of the step-by-step judgment of the value of the proximity distance D. According to such configuration, the safety operation and the sewing operation can be executed simultaneously by controlling the sewing machine motor 56 to decelerate to a predetermined speed or lower or to stop based on the magnitude of proximity of the moving object 73 to the sewing needle 6. That is, in case the sewing needle 6 and the moving object 73 are distant, in other words, in case the proximity distance D is of substantial amount, the sewing operation can be continued with the sewing machine motor 56 decelerated to a state allowing immediate halt, thereby allowing execution of the sewing process while preparing for execution of the safety operation. On the other hand, if the moving object 73 is in immediate proximity of the sewing needle 6, in other words, if the proximity distance D is extremely small, the sewing machine motor 56 may be brought to an emergency halt to stop the sewing process and prioritize the execution of the safety operation.

Since the vertical movement of the needle bar 5 is stopped by the release operation of the needle-bar release mechanism 30, the vertical movement of the needle bar 5 can be stopped immediately even when the sewing machine motor 56 is idle. Thus, the safety of the moving object 73 can be improved even if the moving object 73 is in immediate proximity of the sewing needle 6.

Activation of the warning buzzer 59 and displaying of warning messages to the liquid crystal display 8 allow user perception of the approach of the moving object 73 to the sewing needle 6, thereby enabling quick avoidance of dangerous situations.

Figure 12A:
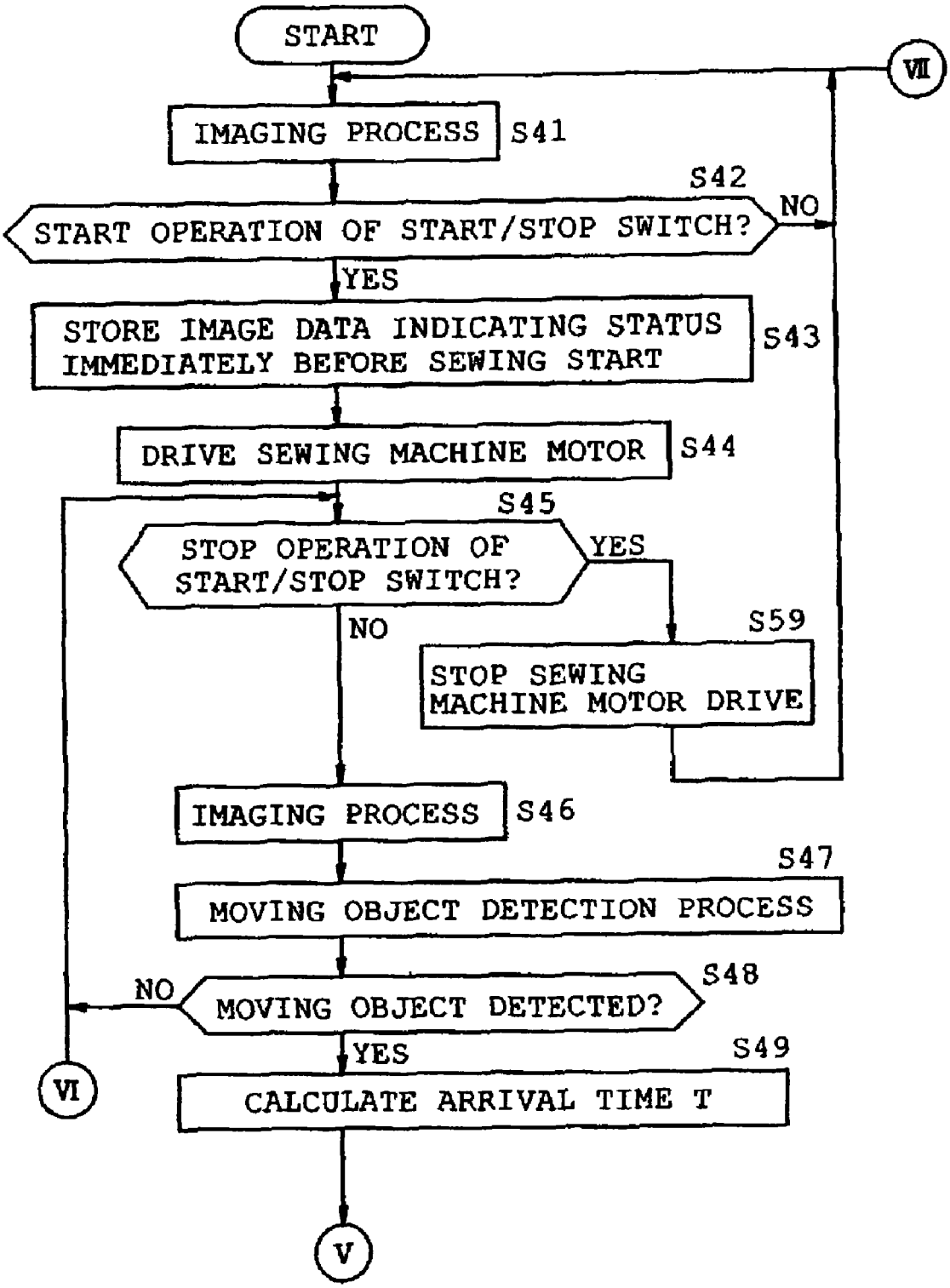
FIGS. 12A and 12B are flowcharts of the safety control in accordance with a second illustrative aspect of the present disclosure.

Next, a second embodiment arrived by partially modifying the safety control (refer to FIGS. 8A, 8B and 8C) of the above described first embodiment will be described with reference to FIGS. 12A and 12B.

The present embodiment is arranged to execute a predetermined safety operation when the time taken for the moving object 73 to enter the vertical moving locus (area in which the sewing needle 6 vertically reciprocates) of the sewing needle 6, in other words, the time taken for the moving object 73 to reach the needle drop position N of the sewing needle 6 is short. Referring to FIG. 12A, the control unit 50 initially executes steps S41 to S48 when this control is started. Steps S41 to S48 correspond to steps S11 to S18 of the first embodiment.

If a moving object 73 is detected in step S48 (YES), the control unit 50 proceeds to step S49 and calculates the time taken for the moving object 73 to reach the needle drop position N as an arrival time T. The arrival time T is calculated based on the moving speed of the moving object 73 and the distance between the position of the moving object 73 to the needle drop position N of the sewing needle 6. Also, the moving speed of the moving object 73 is obtained based on the time interval between each imaging process (imaging interval) when the control unit 50 executes plurality instances of the imaging process (step S46) and the distance (moving distance) traveled by the moving object 73 between the imaging intervals.

Figure 12B:
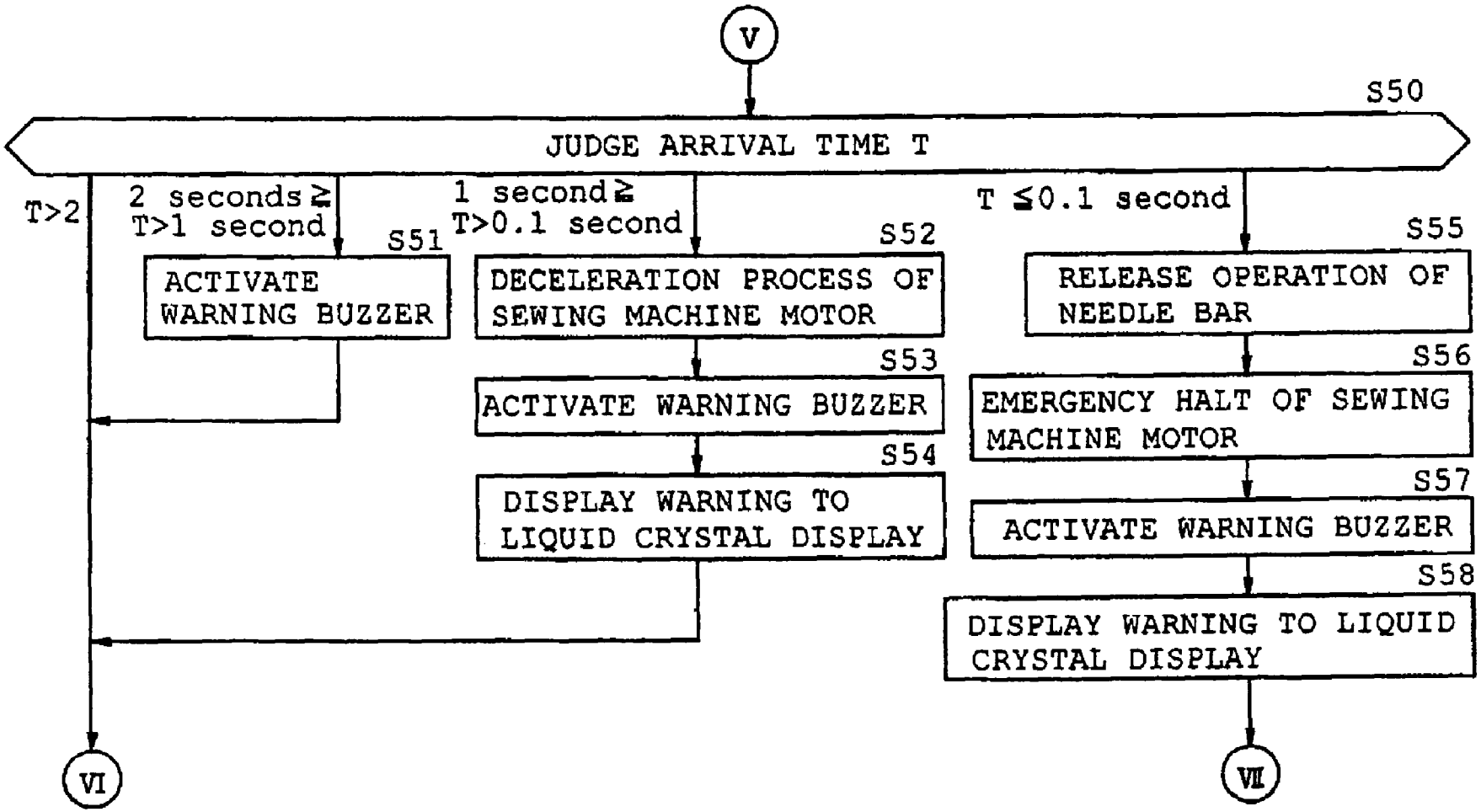

Next, the control unit 50 proceeds to step S50 of FIG. 12B and the value of the arrival time T is judged in a step-by-step manner. Then, the predetermined safety operation is executed based on the result of the judgment of the arrival time T. If the arrival time T is greater than two seconds (T>2), in other words, if the time taken for the moving object 73 to contact the sewing needle 6 is long, the control unit 50 repeats steps 45 onwards. If the arrival time T is equal to or less than 2 seconds and greater than 1 second (2 seconds≧T>1 second), the control unit 50 proceeds to step S51 and warns the user by the warning buzzer 59.

If the arrival time T is equal to or less than 1 second and greater than 0.1 second (1 second≧T>0.1 second), the control unit 50 proceeds to step S52 and executes the deceleration process that decelerates the rotational speed of the sewing machine motor 56 to a predetermined speed. Then, the control unit 50 warns the user by activating the warning buzzer 59 (step S53) and displays a warning message to the liquid crystal display 8 (step S54).

If the arrival time T is equal to or less than 0.1 second (T≦0.1 second), in other words, if the moving object 73 reaches the proximity of the sewing needle 6 in a short time, the control unit 50 proceeds to step S55 and executes a release operation of the needle bar 5. In the release operation, the needle bar 5 is released via the needle-bar release mechanism 30 by driving the drive motor 40. Next, the control unit 50 proceeds to step S56 and brings the sewing machine motor 56 to an emergency halt. Then, the control unit 50 warns the user of the emergency halt by activating the warning buzzer 59 (step S57) and displays a warning message to the liquid crystal display 8 (step S58). Thereafter, the control unit 50 repeats steps S41 onwards.

As described above, according to the present embodiment, the time taken for the moving object 73 to enter the vertical movement locus is calculated as arrival time T based on the image data containing the sewing needle 6 and the moving object 73 in close proximity of the sewing needle 6. In case the calculated arrival time T is equal to or less than the predetermined time, the predetermined safety operation is executed. Thus, when foreign objects such as user's fingers approach the sewing needle 6, user safety can be secured reliably.

In the present embodiment also, considerable enhancement of user safety can be achieved by mere provision of a single image sensor 9. Further, user safety can be secured reliably when foreign objects such as user's fingers approach the sewing needle 6 with a configuration which is easy to install, provides good workability in low cost and compact spacing.

The predetermined safety operation is executed based on the result of the step-by-step judgment of the value of the arrival time T. Thus, the safety operation and the sewing operation can be executed simultaneously based on the magnitude of proximity of the moving object 73 to the sewing needle 6. In other words, in case the arrival time T is of substantial amount, the sewing process may be executed while preparing for execution of the safety operation. On the other hand, if the arrival time T is extremely short, the sewing operation may be stopped to prioritize the execution of the safety operation.

The present disclosure is not limited to the foregoing embodiments but may be modified or expanded as follows.

Figure 8A:
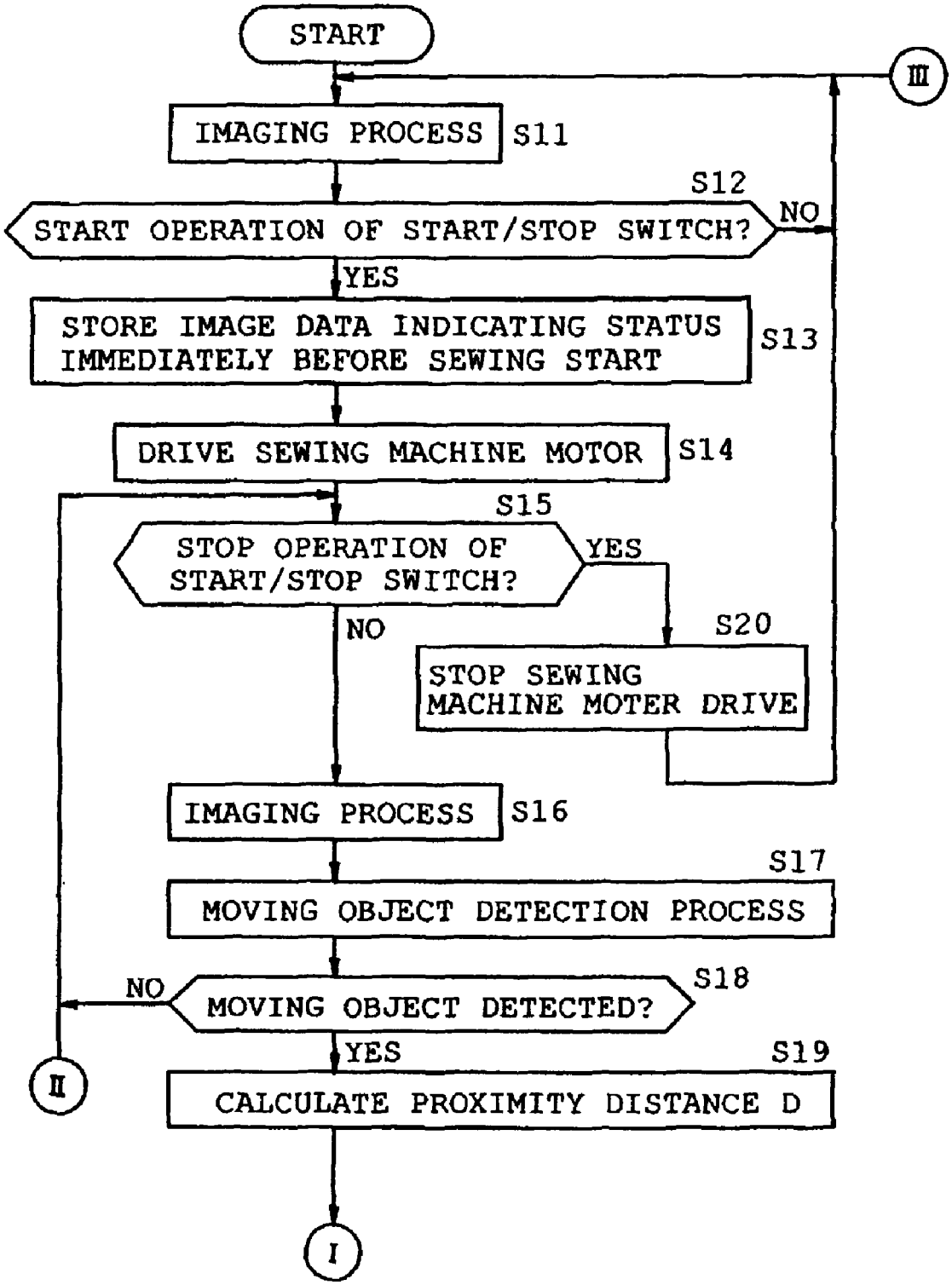
FIGS. 8A, 8B and 8C are flowcharts of a safety control.
Figure 8B:
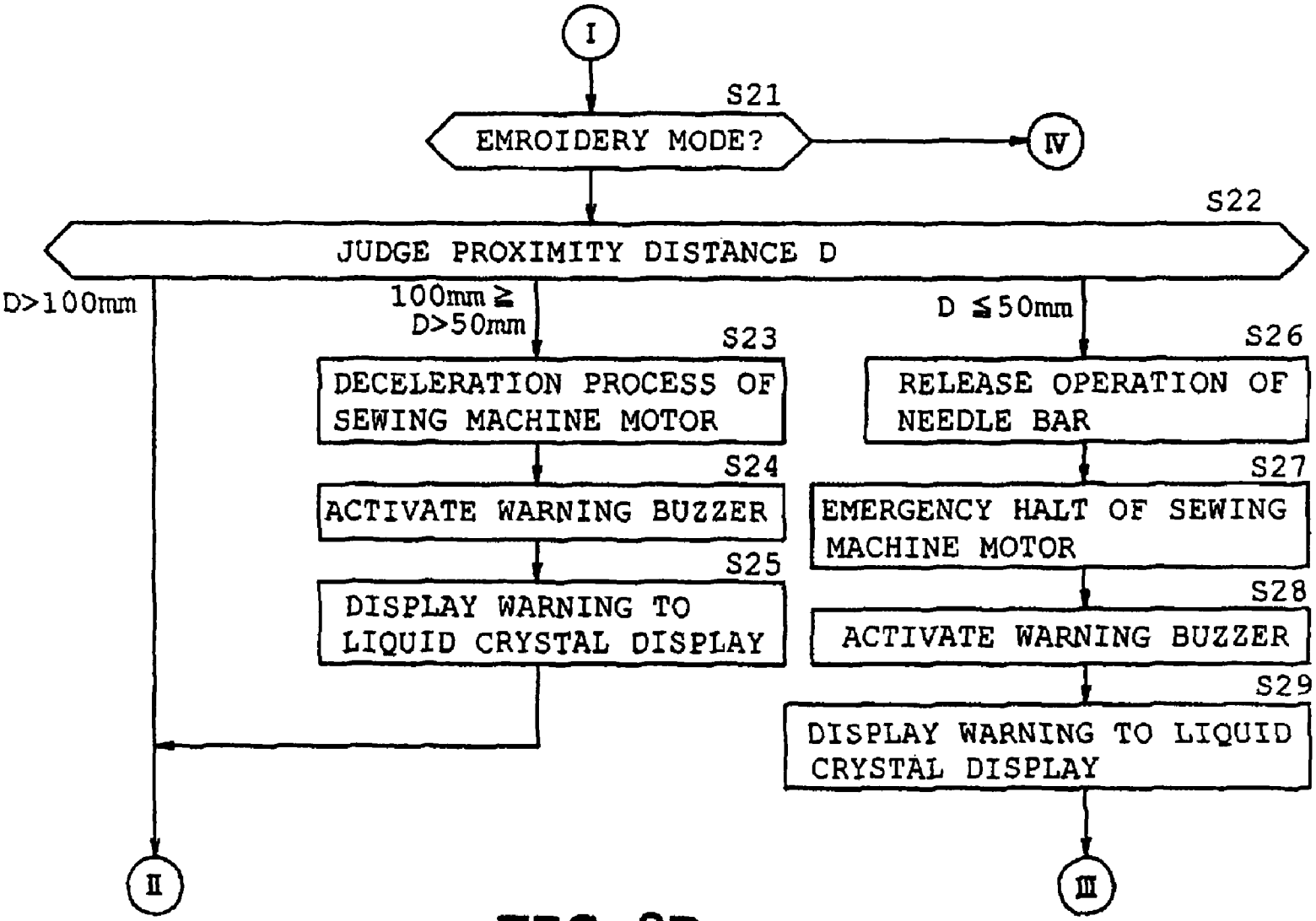
Figure 8C:
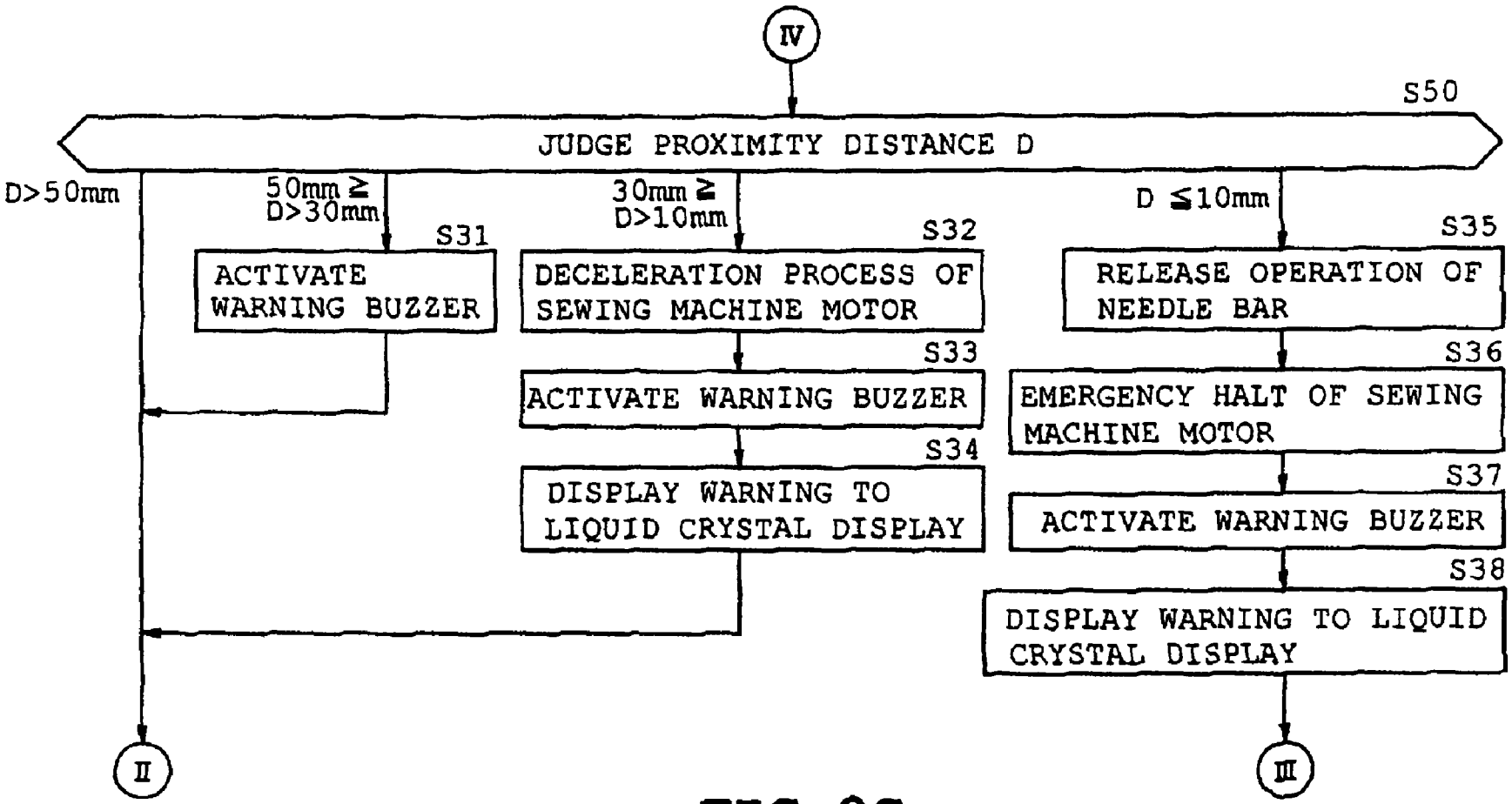

A danger zone may be designated in areas where user safety may be hindered in the safety control indicated in FIGS. 8A, 8B and 8C and the predetermined safety control may be executed when a moving object 73 enters the predetermined danger zone. More specifically, a step may be introduced in which the control unit 50 judges whether or not a moving object 73 has entered the predetermined danger zone based on the image data captured in step S11 when the start operation is operated on the start/stop switch 7 (YES in step S12). Then, when the control unit 50 determines that the moving object 73 has entered the danger zone, the warning buzzer 59 may be activated and a warning may be displayed on the liquid crystal display 8.

The image sensor 9 is not limited to a CCD image sensor but may employ a CMOS image sensor and other various imaging elements.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A sewing machine, comprising:

a needle bar that has a sewing needle attached in a lower end thereof;

a needle-bar vertical drive mechanism that vertically moves the needle bar by a sewing machine motor via a sewing machine main shaft;

an imaging unit that captures image data of at least the sewing needle and a moving object that is in close proximity of the sewing needle;

a distance calculating portion that calculates a distance between the sewing needle and the moving object based on the image data captured by the imaging unit;

a judging portion that makes a judgment whether the distance calculated by the distance calculating portion is equal to or less than a predetermined distance; and a control portion that controls execution of a predetermined safety operation based on the judgment of the judging portion;

wherein the moving object is other than the needle, and wherein the control portion decelerates the sewing machine motor to a speed equal to or less than a predetermined speed or stops the sewing machine motor as the predetermined safety operation.

2. The sewing machine of claim 1, wherein the predetermined distance is set in a step-by-step manner and the control portion judges the calculated distance based on comparison with the predetermined distance and the predetermined safety operation is executed depending upon a result of the judgment.

3. The sewing machine of claim 1, wherein the imaging unit is composed of a CCD image sensor or a CMOS image sensor.

4. A sewing machine, comprising:

a needle bar that has a sewing needle attached in a lower end thereof;

a needle-bar vertical drive mechanism that vertically moves the needle bar by a sewing machine motor via a sewing machine motor main shaft;

an imaging unit that captures image data of at least the sewing needle and a moving object that is in close proximity of the sewing needle;

a distance calculating portion that calculates a distance between the sewing needle and the moving object based on the image data captured by the imaging unit;

a judging portion that makes a judgment whether the distance calculated by the distance calculating portion is equal to or less than a predetermined distance; and a control portion that controls execution of a predetermined safety operation based on the judgment of the judging portion;

wherein the moving object comprises a user's fingers.

5. The sewing machine of claim 4, wherein the control portion decelerates the sewing machine motor to a speed equal to or less than a predetermined speed or stops the sewing machine motor as the predetermined safety operation.

6. The sewing machine of claim 4, further comprising a needle-bar release mechanism that executes a release operation that blocks synchronization of the needle bar and the sewing machine main shaft, wherein the control portion stops the vertical movement of the needle bar by controlling the needle-bar release mechanism to execute the release operation as the predetermined safety operation.

7. The sewing machine of claim 4, further comprising an alarming portion capable of issuing a warning, wherein the control portion controls the alarming portion to issue the warning as the predetermined safety operation.

8. The sewing machine of claim 4, wherein the predetermined distance is set in a step-by-step manner and the control portion judges the calculated distance based on comparison with the predetermined distance and the predetermined safety operation is executed depending upon a result of the judgment.

9. The sewing machine of claim 4, wherein the imaging unit is composed of a CCD image sensor or a CMOS image sensor.

10. A sewing machine, comprising:

a needle bar that has a sewing needle attached in a lower end thereof;

a needle-bar vertical drive mechanism that vertically moves the needle bar by a sewing machine motor via a sewing machine main shaft;

an imaging unit that captures image data of at least the sewing needle and a moving object that is in close proximity of the sewing needle;

a distance calculating portion that calculates a distance between the sewing needle and the moving object based on the image data captured by the imaging unit;

a judging portion that makes a judgment whether the distance calculated by the distance calculating portion is equal to or less than a predetermined distance;

a control portion that controls execution of a predetermined safety operation based on the judgment of the judging portion; and an alarming portion capable of issuing a warning, wherein the moving object is other than the needle, and wherein the control portion controls the alarming portion to issue the warning as the predetermined safety operation.

* * * * *